US006553585B1

(12) United States Patent
Lundstrom

(10) Patent No.: US 6,553,585 B1
(45) Date of Patent: Apr. 29, 2003

(54) MECHANIZED TOILET SEAT LIFT FOR THE ELDERLY AND/OR DISABLED

(76) Inventor: Roger Lundstrom, 760 Schoenbeck Rd., Wheeling, IL (US) 60090-5500

( * ) Notice: Subject to any disclaimer, the term of this patent is extended or adjusted under 35 U.S.C. 154(b) by 0 days.

(21) Appl. No.: 10/272,406

(22) Filed: Oct. 16, 2002

(51) Int. Cl.[7] ..... A47K 13/10
(52) U.S. Cl. ..... 4/667
(58) Field of Search ..... 4/667, 246.2, 246.1

(56) References Cited

U.S. PATENT DOCUMENTS 4,581,778 A 4/1986 Pontoppidan
4,833,736 A 5/1989 Sadler et al.
4,993,085 A * 2/1991 Gibbons ..... 4/667
5,063,617 A 11/1991 Ward et al.
5,142,709 A 9/1992 McGuire
5,561,872 A * 10/1996 Phillips ..... 4/667
5,592,703 A * 1/1997 Jones et al. ..... 4/667
6,154,896 A 12/2000 Houston et al.
6,161,229 A * 12/2000 Ryan et al. ..... 4/667
6,360,382 B1 3/2002 Karash

* cited by examiner

*Primary Examiner*—Gregory Huson
*Assistant Examiner*—Huyen Le
(74) *Attorney, Agent, or Firm*—John D. Gugliotta

(57) ABSTRACT

A toilet seat lift aids the elderly and/or the physically disabled in utilizing a toilet. The toilet seat lift includes a conventionally shaped toilet seat affixed with arms, similar to arms on a chair, which are located approximately 8 inches above the seat surface. A control panel with raising and lowering control buttons is provided on one of the arms. An electrical or battery operated hydraulic power pack provides power to a hydraulic cylinder, which raises and lowers the seat. The toilet seat lift attaches to a conventional toilet by use of the two mounting flanges provided for a conventional toilet. The toilet seat lift utilizes a pair of hydraulic cylinders that telescopically expand and contract so as to raise and lower the toilet seat as desired.

13 Claims, 4 Drawing Sheets

MECHANIZED TOILET SEAT LIFT FOR THE ELDERLY AND/OR DISABLED

RELATED APPLICATIONS

The present invention was first described in Disclosure Document Registration 512,399 filed on May 30, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to stabilization systems for lifting devices for the elderly and/or disabled and, more particularly, to a mechanized toilet seat lift for the elderly and/or disabled.

2. Description of the Related Art

Individuals with physical disabilities, or with limited endurance such as the elderly, know all too well of some of the difficulties that they encounter in daily life. Ordinary tasks that most of us take for granted, causes them severe hardship on a daily basis. One of these tasks is the simple act of using the toilet. While lifting aids for recliners and similar chairs are available to help lift and lower the user, these are of no use when the user is trying to use the toilet. Often, assistance from a care provider or family member is necessary, especially when standing back up. This of course severely compromises the privacy and dignity of the person who usually feels extreme embarrassment and loss of independence. Accordingly, there exists a need for a means by which those with physical disabilities or the elderly can easily use a toilet without assistance when sitting down or standing up.

A search of the prior art did not disclose any patents that read directly on the claims of the instant invention; however, the following references were considered related:

U.S. Pat. No. 5,142,709, issued in the name of McGuire, describes a hydraulically operated commode seat assembly;

U.S. Pat. No. 6,360,382, issued in the name of Karash, describes a powered operated commode seat assembly;

U.S. Pat. No. 5,063,617, issued in the name of Ward et al., describes a hydraulically operated commode seat assembly;

U.S. Pat. No. 4,581,778, issued in the name of Pontoppidan, describes a powered operated commode seat assembly;

U.S. Pat. No. 4,833,736, issued in the name of Sadler et al., describes a powered operated commode seat assembly;

U.S. Pat. No. 4,993,085, issued in the name of Gibbons, describes a hydraulically operated commode seat assembly; and U.S. Pat. No. 6,154,896, issued in the name of Houston et al., describes a powered operated commode seat assembly.

Consequently, there is a need for a hydraulically operated toilet seat assembly adapted to be attached to a conventional toilet which includes depressible switches disposed on an arm rest for raising and lowering seat, a back support, and a bidet device for cleansing posterior portions of the body.

SUMMARY OF THE INVENTION

It is therefore an object of the present invention to provide an improved hydraulic toilet seat lift assembly.

It is a feature of the present invention to provide a base unit that fits completely around a toilet.

It is another feature of the present invention to provide a seat that pivots upward at a 45 degree angle.

Briefly described according to one embodiment of the present invention, a toilet seat lift aids the elderly and/or the physically disabled in utilizing a toilet. The toilet seat lift includes a conventionally shaped toilet seat with arms, similar to arms on a chair, located approximately 8 inches above the seat surface. A control panel with raising and lowering control buttons is provided on one of the arms. A battery operated hydraulic power pack provides power to a hydraulic cylinder, which raises and lowers the seat. The toilet seat lift attaches to a conventional toilet by use of the two holes provided for a conventional seat. This allows for installation without modification of the toilet, thus allowing it to be restored to normal use when the toilet seat lift is no longer needed. The toilet seat lift utilizes a pair of hydraulic cylinders that telescopically expand and contract so as to raise and lower a toilet seat. It is also envisioned that an enhanced model of the invention would include a bidet attachment allowing cleansing of the user as well.

Use of the present invention allows the physically disabled or elderly to use the toilet in private with greater ease and safety, while maintaining their dignity.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

| | | | |
|---|---|---|---|
| 10 | mechanized toilet seat lift for the elderly and/or disabled | 80 | control panel |
| 15 | conventional toilet | 85 | arm support rest |
| 20 | mounting flange | 90 | arm support braces |
| 25 | bowl flange nut | 95 | UP control push button switch |
| 30 | power unit enclosure | 100 | DOWN control push button switch |
| 35 | power cord | 105 | hydraulic pump |
| 40 | ground fault interrupter protected receptacle | 110 | electric DC motor |
| 45 | lower frame section | 115 | hydraulic pressure reservoir |
| 50 | reinforcing arm | 120 | three-way control valve |
| 55 | toilet seat | 125 | hydraulic hoses |
| 60 | hinge | 130 | direct current power supply |
| 65 | direction arrow | 135 | battery |
| 70 | first hydraulic cylinder | 140 | over current protective device |
| 75 | second hydraulic cylinder | | |

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
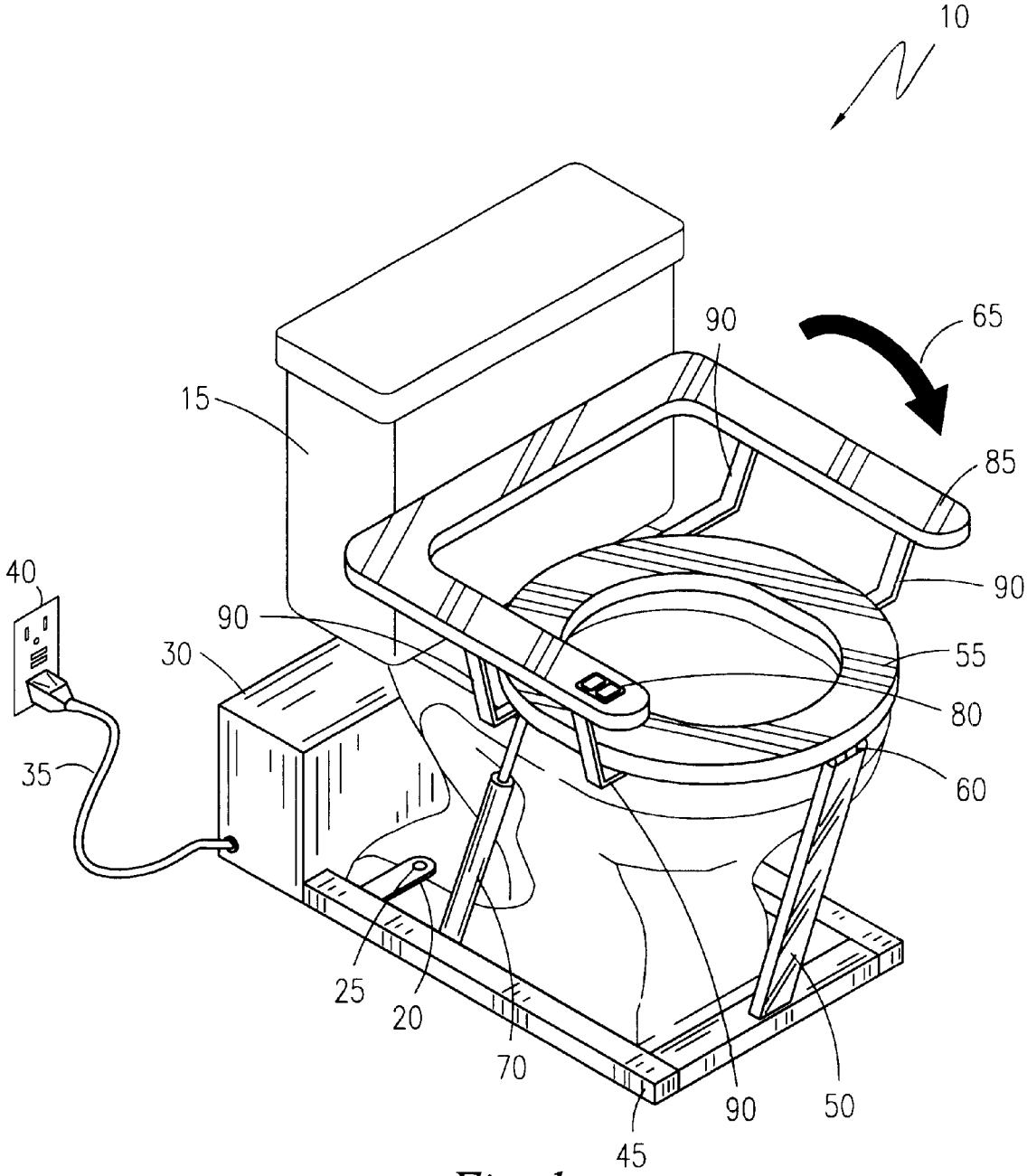
FIG. 1 is an isometric view of the mechanized toilet seat lift for the elderly and/or disabled shown in a lowered state according the preferred embodiment of the present invention.

Referring now to FIG. 1, an isometric view of the mechanized toilet seat lift for the elderly and/or disabled 10, shown in a lowered state according the preferred embodiment of the present invention is disclosed. The mechanized toilet seat lift for the elderly and/or disabled 10 is shown attached to a conventional toilet 15, commonly found in residential, commercial, and institutional environments. The mechanized toilet seat lift for the elderly and/or disabled 10 is attached to the conventional toilet 15 by use of a mounting flange 20, secured under a bowl flange nut 25. This mounting and securing arrangement is typical for both sides of the conventional toilet 15, of which only one is shown here for sake of clarity. A power unit enclosure 30, containing internal electric and hydraulic power elements which will be described in greater detail herein below is located to the lower rear area of the conventional toilet 15. Electric power is routed to the power unit enclosure 30 via a power cord 35 connected to a ground fault interrupter protected receptacle 40. A lower frame section 45, containing internal structural strength elements such as steel angles, hydraulic tubing and electrical wiring is provided in a general "U"-shape around the conventional toilet 15 at floor level. The lower frame section 45 is physically joined to the mounting flange 20 and the power unit enclosure 30 to prevent movement and ensure a stable foundation. At the front center of the lower frame section 45 a reinforcing arm 50 is connected to a toilet seat 55 via a hinge 60. This feature allows the toilet seat 55 to tilt forward at an approximate angle of 45° as defined by a direction arrow 65. The force to accomplish this movement is provided by a first hydraulic cylinder 70 and second hydraulic cylinder 75. The first hydraulic cylinder 70 is anchored at a midpoint of the toilet seat 55 and the forward portion of the lower frame section 45 as shown, with the second hydraulic cylinder 75 performing an identical operation on the mirror side. The extension or retraction of the first hydraulic cylinder 70 and the second hydraulic cylinder 75 is controlled by a control panel 80 on a arm support rest 85. The arm support rest 85 extends in a "U"-shape around the rear of the toilet seat 55 and serves as a guide and comfortable rest for the user when utilizing the mechanized toilet seat lift for the elderly and/or disabled 10 in much the same purpose and function that arms on a chair serve. The arm support rest 85 is supported by a multitude of arm support braces 90 (some of which are partially visible in FIG. 1) located around the side and rear perimeter of the toilet seat 55.

Figure 2:
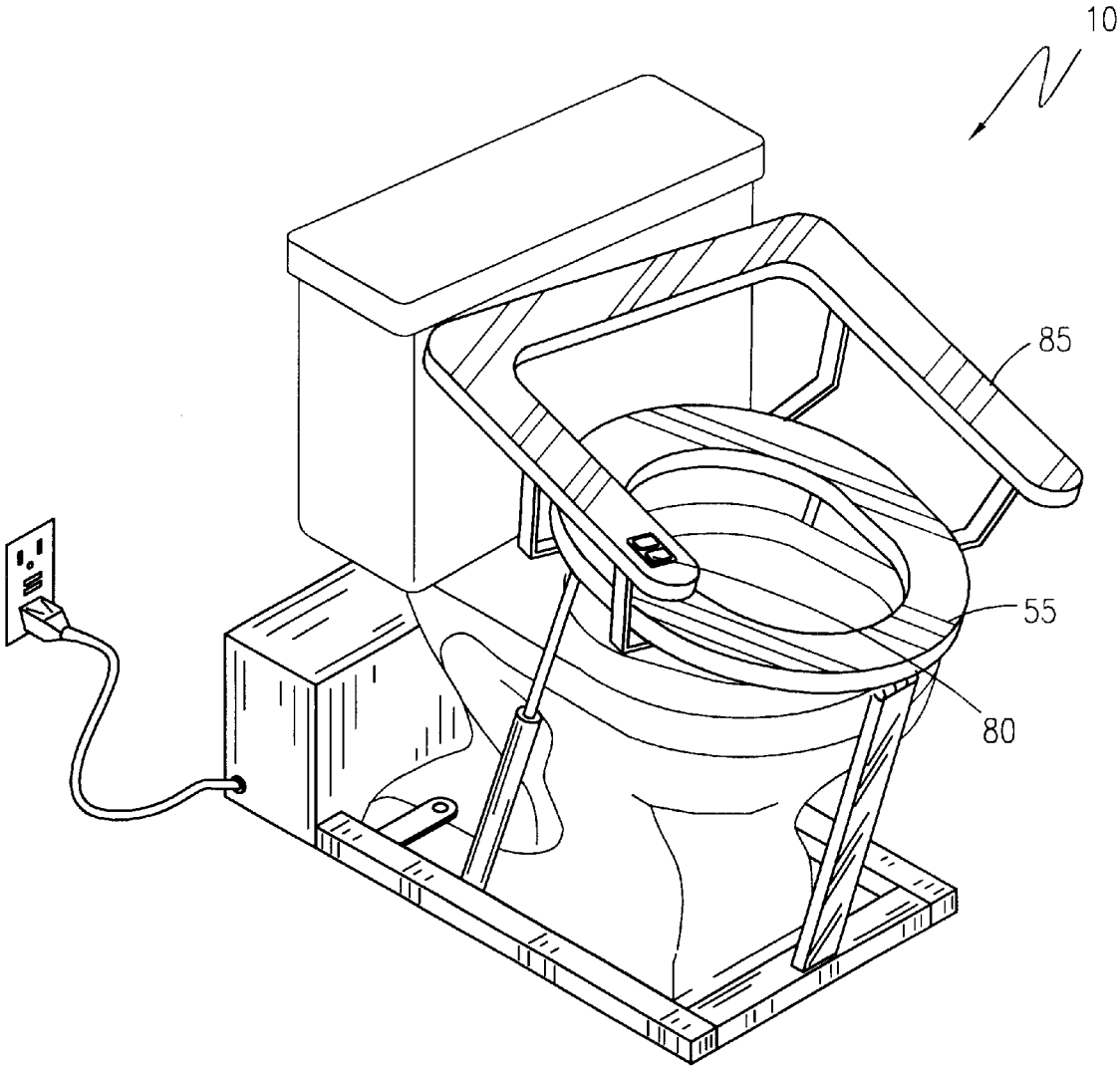
FIG. 2 is an isometric view of the mechanized toilet seat lift for the elderly and/or disabled shown in an elevated state.

Referring now to FIG. 2, an isometric view of the mechanized toilet seat lift for the elderly and/or disabled 10 is shown in an elevated state. FIG. 2 more clearly depicts the inclined nature of the toilet seat 55 when it is in raised or elevated state. Such a state allows the user to sit or lean against the toilet seat 55 then lower it down to its utilization state as shown in FIG. 1. When toilet duties are completed, the user simply raises the toilet seat 55 back up using the controls as provided on the control panel 80. In this raised position, the elderly or disabled user is more able to stand up in a comfortable manner without stressing or straining, back, leg or arm muscles. Additionally, the arm support rest 85 serves as a stabilizing member upon which the user may rest their forearm or grasp for additional leverage when getting up or sitting down.

Figure 3:
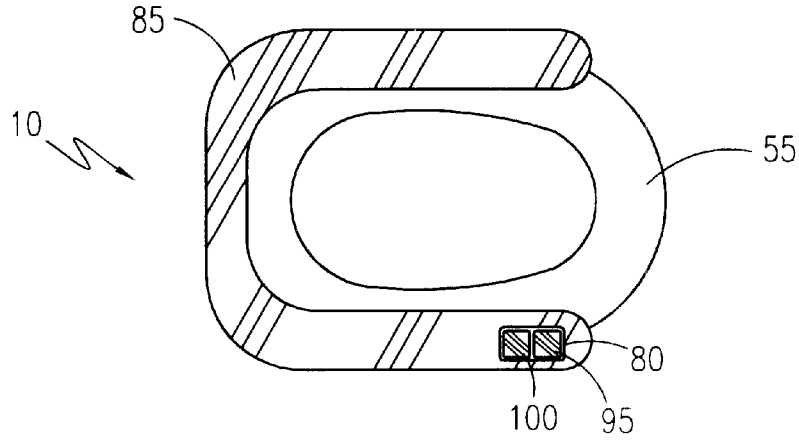
FIG. 3 is a top view of the mechanized toilet seat lift for the elderly and/or disabled.

Referring next to FIG. 3, a top view of the mechanized toilet seat lift for the elderly and/or disabled 10 is depicted. FIG. 3 more clearly shows the relationship between the toilet seat 55 and the arm support rest 85 and how adequate space for the user to sit upon the toilet seat 55 is provided. Due to the recessed nature of the toilet seat 55 to the arm support rest 85, it ensures that the user will not fall from the toilet seat 55, no matter how unstable or unsteady they are. Also visible in FIG. 3 is the control panel 80, located on either the right or left hand of the arm support rest 85 (shown here on the right hand side for sake of clarity). The control panel 80 consists of an UP control push button switch 95 and a DOWN control push button switch 100 to raise and lower the toilet seat 55. The UP control push button switch 95 and DOWN control push button switch 100 are envisioned to be normally open switches and of a waterproof nature. Internal wiring from the UP control push button switch 95 and DOWN control push button switch 100 will be routed in the arm support rest 85, down an arm support brace 90 (as shown in FIG. 1), through the toilet seat 55 (as shown in FIG. 1) to and across the hinge 60 (as shown in FIG. 1) and through the support arm 50 (as shown in FIG. 1) and lower frame section 45 (as shown in FIG. 1) until it reaches the power unit enclosure 30 (as shown in FIG. 1). This path provides ease of control yet offers physical protection for the wiring. The wiring details will be shown in greater detail herein below.

Figure 4:
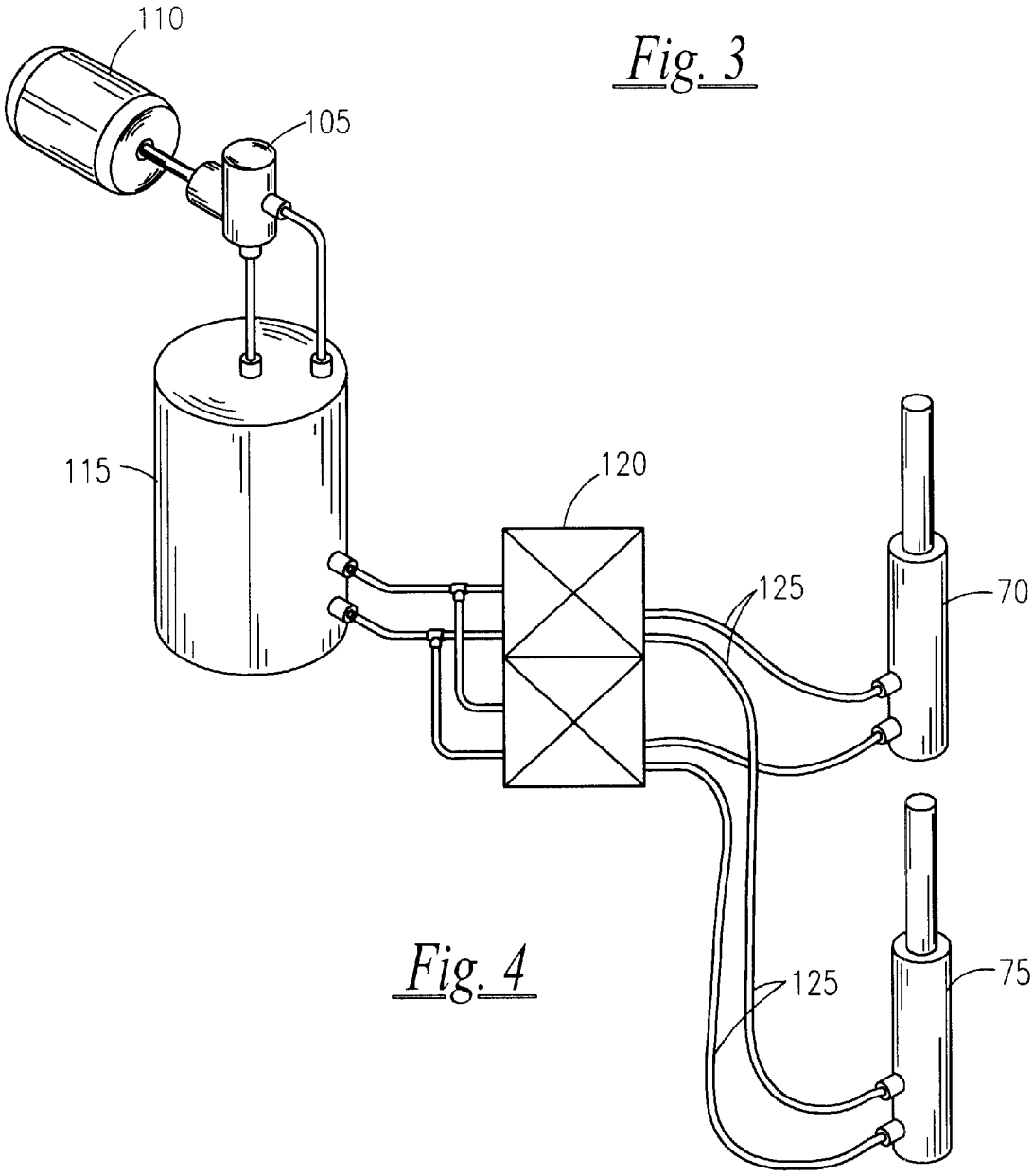
FIG. 4 is a hydraulic flow diagram associated with the mechanized toilet seat lift for the elderly and/or disabled.

Referring now to FIG. 4, a hydraulic flow diagram associated with the mechanized toilet seat lift for the elderly and/or disabled 10, and more specifically the power unit enclosure 30, is disclosed. Hydraulic power is generated by a hydraulic pump 105, through the use of mechanical energy from an electric DC motor 110. This hydraulic power is stored in a hydraulic pressure reservoir 115. Hydraulic pressure is then routed to a pair of three-way control valves 120. Upon receipt of the appropriate electrical command, the three-way control valve 120 routes hydraulic pressure to the first hydraulic cylinder 70 and the second hydraulic cylinder 75 through a series of hydraulic hoses 125. The hydraulic hoses 125 are routed in the lower frame section 45 (as shown in FIG. 1) and terminate within the power unit enclosure 30 (as shown in FIG. 1). The other components such as the hydraulic pump 105, the electric DC motor 110, the hydraulic pressure reservoir 115, and the three-way control valve 120 are located within the power unit enclosure 30 (as shown in FIG. 1) as well. The hydraulic nature of the invention provides for smooth operation with built in and integral limit switches on the first hydraulic cylinder 70 and the second hydraulic cylinder 75, without the sporadic and/or "jerky" operation of a pure mechanical unit.

Figure 5:
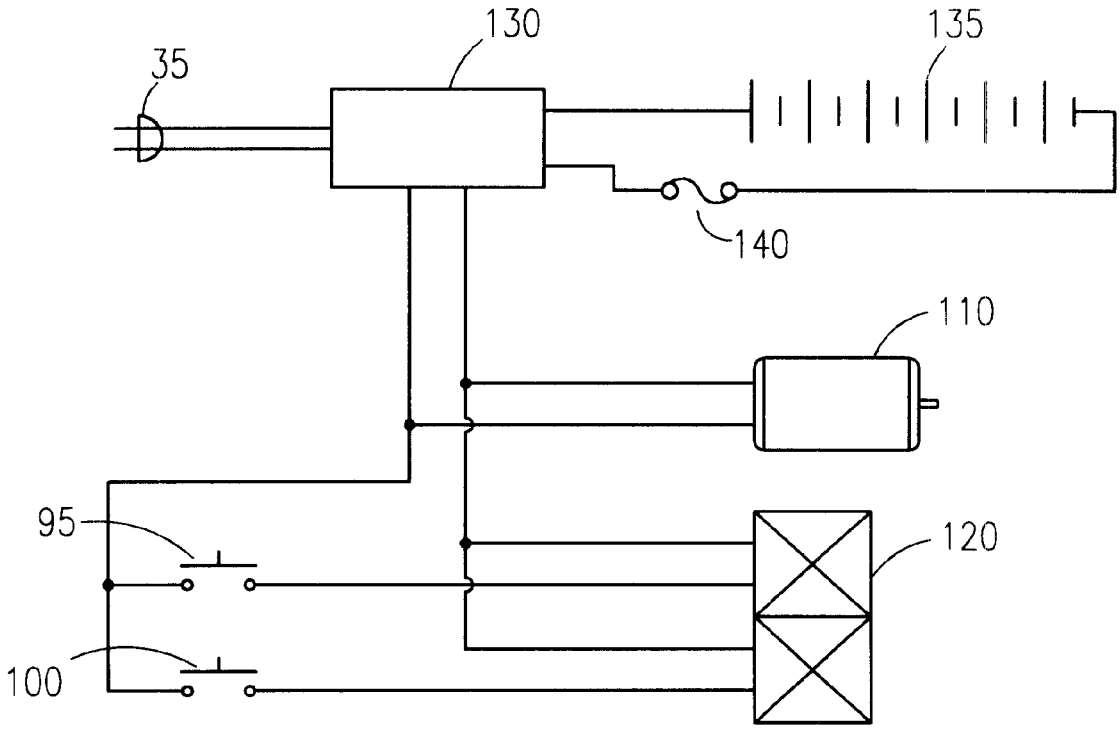
FIG. 5 is an electrical schematic diagram associated with the mechanized toilet seat lift for the elderly and/or disabled.

Referring finally to FIG. 5, an electrical schematic diagram associated with the mechanized toilet seat lift for the elderly and/or disabled 10 is depicted. Electrical power is delivered via the power cord 35 to a direct current power supply 130. The direct current power supply 130 serves two purposes. First it provides a DC voltage to the electric DC motor 110 and to the pair of three-way control valve 120 for operating purposes. Second, the direct current power supply 130 provides a charging current to a battery 135, through an over current protective device 140, such as a fuse. The battery 135 is envisioned to be a deep-cycle lead acid battery, similar to those used for powering electric marine motors. Should commercial electric power be lost at the ground fault interrupter protected receptacle 40 (as shown in FIG. 1), the battery 135 will provide power to the mechanized toilet seat lift for the elderly and/or disabled 10 for a period of time envisioned to be twenty four hours, although shorter or longer times are possible dependent on the size of the battery 135 and usage frequency of the mechanized toilet seat lift for the elderly and/or disabled 10. In such a manner, the mechanized toilet seat lift for the elderly and/or disabled 10 can be used by the elderly or the disabled without reliance on commercial power. Electrical power also is routed through the UP control push button switch 95 and the DOWN control push button switch 100 which supply a corresponding signal to the pair of three-way control valve 120 to allow for the lowering and raising of the toilet seat 55 (as seen in FIG. 1).

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The present invention is designed with ease of operation features in mind that allow it to be utilized by a common user with little or no training or experience. After acquisition of the mechanized toilet seat lift for the elderly and/or disabled 10, it must be installed on a conventional toilet 15. Installation is simple and can be accomplished by a do-it-yourselfer or a professional contractor. First, the mounting flange 20 on the lower frame section 45 is secured via the bowl flange nut 25 on the conventional toilet 15. Should a conventional toilet seat be previously installed, it should be removed. Next, the power cord 35 is plugged into a ground fault interrupter protected receptacle 40, and the mechanized toilet seat lift for the elderly and/or disabled 10 is ready for utilization.

To use the mechanized toilet seat lift for the elderly and/or disabled 10, a user approaches it when it is in the up position as shown in FIG. 2. The user, with their buttocks exposed, turns away from the mechanized toilet seat lift for the elderly and/or disabled 10 and sits or leans up against the toilet seat 55. Next, using the DOWN control push button switch 100 on the control panel 80, the user lowers the toilet seat 55 into its utilization configuration.

When bathroom duties are finished, the user uses the UP control push button switch 95 on the control panel 80 to instruct the mechanized toilet seat lift for the elderly and/or disabled 10 to raise the toilet seat 55 to its extended or deployed position as shown in FIG. 1. Then, using the arm support rest 85 for support, the user regains an erect and upright position. Additionally, with this cycle, the mechanized toilet seat lift for the elderly and/or disabled 10 is reset in position for its next use.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A mechanized toilet seat lift comprising:

an arm support rest, said arm support rest suspended above a toilet seat by a plurality of arm support braces, said arm support rest providing arm support to a user;

a control panel, said control panel positioned along said arm support rest, said control panel provided for operation of said toilet seat lift;

a first hydraulic cylinder, said first hydraulic cylinder providing hydraulic force for lifting or lowering of said toilet seat;

a second hydraulic cylinder, said second hydraulic cylinder providing force for lifting or lowering of said toilet seat, said second hydraulic cylinder positioned opposite to said first hydraulic cylinder;

a lower frame section, said lower frame section affixed about a base of a toilet, said lower frame section housing said first hydraulic cylinder and said second hydraulic cylinder;

a power unit enclosure, said power unit enclosure positioned at a rear of said toilet base, said power unit enclosure affixed to said lower frame section; said power unit enclosure providing electrical and hydraulic power to said toilet lift seat;

a power cord, said power cord affixed to said power unit enclosure, said power cord supplying electrical power from an electrical outlet to said power unit enclosure; and a mounting flange, said mounting flange securing said toilet seat lift to said toilet.

2. The toilet seat lift of claim 1, wherein said arm support rest comprises a U-shaped perimeter wherein the open end of said U-shaped arm support rest is oriented to a front of said toilet so as to accommodate ingress and egress of a user.

3. The toilet seat lift of claim 2, wherein said arm support rest prevents said user from falling from said toilet during use.

4. The toilet seat lift of claim 3, wherein said arm support rest provides support to said user when said toilet seat is upwardly lifted by said toilet seat lift.

5. The toilet seat lift of claim 1, wherein said control panel comprises:

an UP control switch, said UP control switch for instructing said toilet seat lift to lift said toilet seat; and a DOWN control switch, said DOWN control switch for instructing said toilet seat lift to lower said toilet seat.

6. The toilet seat lift of claim 5, wherein said control panel receives electrical power, said electrical power routed through said UP control switch and said DOWN control switch, said UP control switch and said DOWN control switch supplying a corresponding electrical signal to allow for the lowering and raising of said toilet seat.

7. The toilet seat lift of claim 1, wherein said lower frame section comprises a U-shaped perimeter, said lower frame section affixed to an end of said first hydraulic cylinder and to an end of said second hydraulic cylinder.

8. The toilet seat lift of claim 1, wherein said power unit enclosure comprises:

a hydraulic pump, said hydraulic pump generating hydraulic power;

a motor, said motor providing electrical signals to said hydraulic pump;

a hydraulic pressure reservoir, said hydraulic pressure reservoir storing said hydraulic power generated by said hydraulic pump;

a pair of three-way control valves, said pair of three-way control valves for routing said hydraulic power released from said hydraulic pressure reservoir, and a plurality of hydraulic hoses, said plurality of hoses transporting said hydraulic power from said pair of three-way control valves to said first hydraulic cylinder and said second hydraulic cylinder.

9. The toilet seat lift of claim 8 further comprising a battery, said battery engaged when electrical current is interrupted from said electrical outlet to said power unit enclosure.

10. The toilet seat lift of claim 8, wherein said first hydraulic cylinder and said second hydraulic cylinder each comprise an integral limit switch, said integral limit switch providing a smooth transition of hydraulic power from said hydraulic hoses to said first hydraulic cylinder and said second hydraulic cylinder.

11. The toilet seat lift of claim 10, wherein said first hydraulic cylinder is affixed to said lower frame section at one end, said first hydraulic cylinder is affixed to an underside of said toilet seat at an end opposite to said lower frame section, said first hydraulic cylinder positioned along a lateral side of said toilet.

12. The toilet seat lift of claim 11, wherein said second hydraulic cylinder is affixed to said lower frame section at one end, said second hydraulic cylinder is affixed to an underside of said toilet-seat at an end opposite to said lower frame section, said second hydraulic cylinder positioned along a lateral side of said toilet opposite to said first hydraulic cylinder.

13. The toilet seat lift of claim 12, wherein said UP control switch electrically communicates with said power unit enclosure by the steps comprising:

a. depressing said UP control switch;

b. transmitting electrical signal from said UP control switch to said motor;

c. transmitting a second electrical signal from said motor to said hydraulic pump;

d. generating said hydraulic power within said hydraulic pump;

e. storing said hydraulic power within said hydraulic pressure. reservoir;

f. releasing said hydraulic power from said hydraulic pressure reservoir;

g. routing said hydraulic power from said hydraulic pressure reservoir to said plurality of hydraulic hoses, said routing achieved by said pair of three-way control valves;

h. transporting said hydraulic power to said first hydraulic cylinder and said second hydraulic cylinder; and i. telescoping expansion of said first hydraulic cylinder and said second hydraulic cylinder, thereby lifting said toilet seat.

* * * * *